US005819544A

United States Patent [19]

Andonian

[11] Patent Number: 5,819,544

[45] Date of Patent: Oct. 13, 1998

[54] HIGH PRESSURE CRYOGENIC PUMPING SYSTEM

[76] Inventor: Martin D. Andonian, 25 Fairbanks Rd., Lexington, Mass. 02173

[21] Appl. No.: 584,568

[22] Filed: Jan. 11, 1996

[51] Int. Cl.[6] ..... F17C 7/02

[52] U.S. Cl. ..... 62/50.6; 62/50.2

[58] Field of Search ..... 62/50.1, 50.6, 62/50.7, 49.2; 417/53, 901

[56] References Cited

U.S. PATENT DOCUMENTS

| | | | |
|---|---|---|---|
| 4,472,946 | 9/1984 | Zwick | 62/55 |
| 5,513,961 | 5/1996 | Engdahl et al. | 417/313 |
| 5,537,828 | 7/1996 | Borcuch et al. | 62/50.1 |

*Primary Examiner*—Henry A. Bennett
*Assistant Examiner*—Pamela A. O'Connor
*Attorney, Agent, or Firm*—Robert T. Dunn, Esq.

[57] ABSTRACT

A high pressure pumping system for pumping cryogenic liquid from a low pressure holding cylinder to a high pressure gas cylinder (or other high pressure utilization system) includes a high pressure piston pump having a unidirectional flow input and a unidirectional flow output, immersed in the cryogenic liquid in a low pressure pump container that is fed cryogenic liquid from the low pressure holding cylinder, the pressure in said pump container being maintained so that driving the pump piston pumps cryogenic liquid from the bulk tank to the high pressure utilization system.

20 Claims, 4 Drawing Sheets

HIGH PRESSURE CRYOGENIC PUMPING SYSTEM

BACKGROUND OF THE INVENTION

This invention relates to high pressure pumps for pumping cryogenic liquid such as liquid oxygen, liquid nitrogen, or liquid argon and more particularly to piston pumps for that purpose.

Heretofore piston pumps have been used for pumping cryogenic liquid such as liquid oxygen, liquid nitrogen, or liquid argon. A problem has been the difficulty of operating a high pressure piston pump with boiling cryogenic liquid, because as the piston is withdrawn from the pump chamber cavitation occurs at the input (a partial vacuum is formed), which causes the liquid to boil. The vapor formed by this cavitation prevents liquid from entering the piston pump chamber and as a result the pump does not operate efficiently. A positive pressure of cryogenic liquid at the inlet to the pump is required to prevent this cavitation. To provide such a positive pressure, it has been the practice to locate the pump below the bulk liquid tank containing the liquid oxygen, liquid nitrogen, or liquid argon, so that the height of liquid in the tank above the pump inlet valve provides sufficient pressure to prevent the cavitation. The minimum height of liquid for many pumps is 2 ft. to provide the required net positive suction head (NPSH).

Cryogenic liquid stored in bulk by large volume suppliers is usually contained in a large outdoor bulk liquid tank that is highly thermally insulated and the conventional piston pump is usually two or more feet below the bottom of the tank and usually under the tank. This insures that there will be the necessary NPSH (2 feet) even when the tank is nearly empty. Such pumps are driven electrically or pneumatically in both directions. That is the piston is driven to draw cryogenic fluid into the pump chamber as well as to force the liquid out of the chamber at high pressure.

A usual service by large volume cryogenic liquid suppliers for customers is to fill commercial high pressure gas cylinders with the gas stored as a cryogenic liquid in the bulk tank. For that purpose, the pump output pressure must be at least as high as the required high pressure gas cylinder pressure. Typical pressures are: for the large volume bulk tank, (at the top of the tank), 50 psig.; and for the high pressure gas cylinder, up to 3,500 psig.

Small volume suppliers, who store the cryogenic liquid in much smaller bulk portable cryogenic liquid storage cylinders, that are sometimes on wheels so that they can be rolled about, cannot locate the high pressure pump under the bulk liquid storage cylinder and even if they could there would not be two feet of liquid head above the pump input, particularly when the liquid storage cylinder is only partly full. There is a need for a high pressure pump system to pump from portable cryogenic liquid storage cylinder to a high pressure utilization system that does not depend on the liquid head from the liquid storage cylinder to operate efficiently. It is an object of the present invention to satisfy that need.

SUMMARY OF THE INVENTION

It is the object of the present invention to provide a cryogenic liquid pump system, wherein the problems that arise due to cavitation of the cryogenic liquid are avoided.

It is the object of the present invention to provide an improved cryogenic liquid pump system for pumping cryogenic liquid from a relatively low pressure cryogenic liquid holding cylinder at relatively high pressure for high pressure utilization.

It is another object to provide a cryogenic liquid pump system using a piston pump for which the pump inlet valve pressure is sufficiently high that cavitation does not occur in the cryogenic liquid during operation of the pump.

It is another object to provide a cryogenic liquid pump system using a high pressure piston pump provided sufficient pressure at the pump inlet valve to avoid cavitation in the liquid.

It is another object to provide a cryogenic liquid pump system using a high pressure piston pump provided sufficient pressure at the pump inlet valve to meet the required net positive suction head (NPSH) requirements for the pump and the cryogenic liquid.

It is a further object that the cryogenic liquid pump system can operate according to any of the above objects and need not be fed cryogenic liquid from the bottom of the cryogenic liquid holding cylinder.

It is a further object that the cryogenic liquid pump system can operate according to any of the above objects when fed cryogenic liquid from the top of the cryogenic liquid holding cylinder.

It is another object to provide a cryogenic liquid pump system using a piston pump for which the pump inlet valve pressure is sufficiently high that the cryogenic liquid does not boil during operation of the pump, the pump system operating to pump cryogenic liquid from a relatively small portable cryogenic liquid holding cylinder to a conventional high pressure gas cylinder.

It is another object to provide a high pressure cryogenic liquid pump system for portable cryogenic liquid holding cylinders where the pump cannot be located under the holding cylinder.

It is another object to provide such a pump system that operates continuously to pump cryogenic liquid from the holding cylinder.

It is another object to provide such a method of continuously pumping cryogenic liquid from the holding cylinder to the high pressure utilization.

In accordance with the present invention, a high pressure pumping system for pumping cryogenic liquid from a low pressure portable liquid holding cylinder to a high pressure gas cylinder (or other high pressure utilization system) includes a high pressure piston pump having a unidirectional flow input and a unidirectional flow output, immersed in a cryogenic liquid in a pump container that is fed cryogenic liquid from the low pressure storage container, the low pressure being maintained so that driving the pump piston pumps cryogenic liquid from the holding cylinder to the high pressure utilization system.

DESCRIPTION OF EMBODIMENTS OF THE INVENTION

Cryogenic liquid stored in bulk by small suppliers and by some customers who purchase and store the cryogenic liquid and pump it to a high pressure gas cylinder feed system for their own use, is usually contained in a relatively small, often mobile cryogenic liquid holding cylinder that is highly thermally insulated.

As mentioned above, large suppliers dispense the cryogenic liquid stored in a large bulk tank by pumping the liquid directly from the bottom of the bulk tank to a high pressure gas cylinder filling system and for that purpose a high pressure piston pump has been used a few feet below the tank so that the liquid fed to it will be at sufficiently high pressure that cavitation does not occur at the pump inlet as the pump piston is driven to withdraw and fill the pump chamber.

The invention herein provides a high pressure piston pump mounted inside a small pump container wherein it is immersed in the cryogenic liquid it pumps. This cools the pump which helps to minimize cavitation or boiling at the pump input that can occur when the piston is driven to draw cryogenic liquid into the pump chamber. In addition, the pump container can be filled to a level that provides the NPSH required to avoid cavitation and/or pressure is maintained in the pump container to insure that cavitation does not occur. This piston pump system enables the pump to be operated until the liquid level in the pump container drops below the level of the pump inlet valve and/or the cryogenic liquid holding cylinder is pumped to empty.

Figure 1:
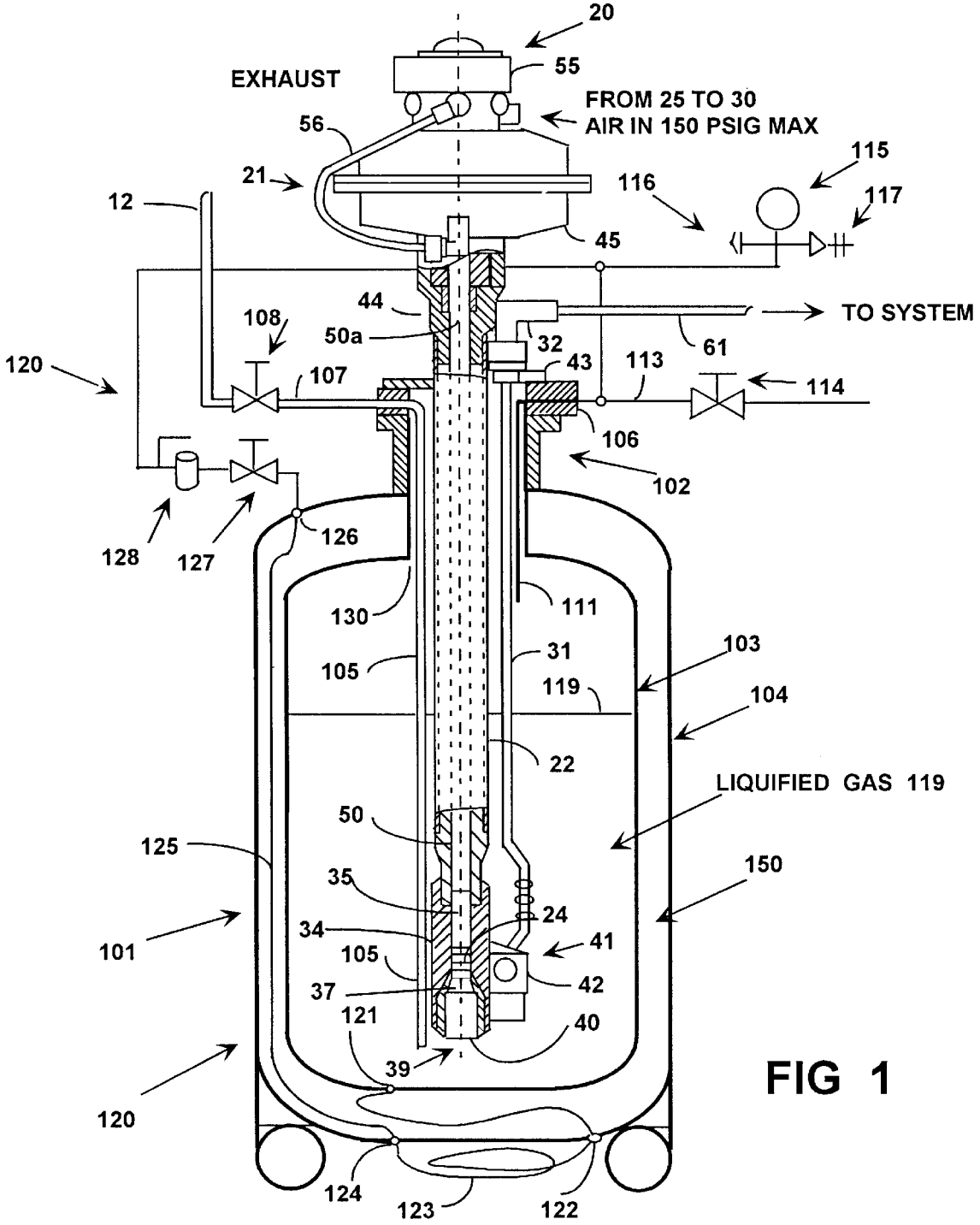
FIG. 1 is a plan partially schematic and cross section view of the high pressure cryogenic liquid pump system according to the present invention, operating to pump cryogenic liquid from a portable cryogenic liquid holding cylinder (shown in FIG. 2) containing the liquid to a high pressure cryogenic liquid utilization system (also shown in FIG. 2), the pump system pump container being shown in cross section schematic to reveal the principal parts thereof.

A pump system 2 according to the present invention is shown in FIG. 1, which is a plan schematic cross section view of the pneumatically driven (air driven) pump 20 mounted in the pump container 101, which is shown schematically in cross section, as part of the high pressure cryogenic liquid pump system. The pump system 2 pumps cryogenic liquid from a mobile liquid holding cylinder 1 (shown in FIG. 2) containing the cryogenic liquid, to a high pressure cryogenic liquid utilization system 7 (also shown in FIG. 2), the pump system pump container 101 being shown in cross section schematic to reveal the principal parts thereof and the air driven pump 20 being shown enlarges in FIG. 3, partially in cross section to show details of a suitable pneumatically driven high pressure cryogenic liquid piston pump.

Figure 2:
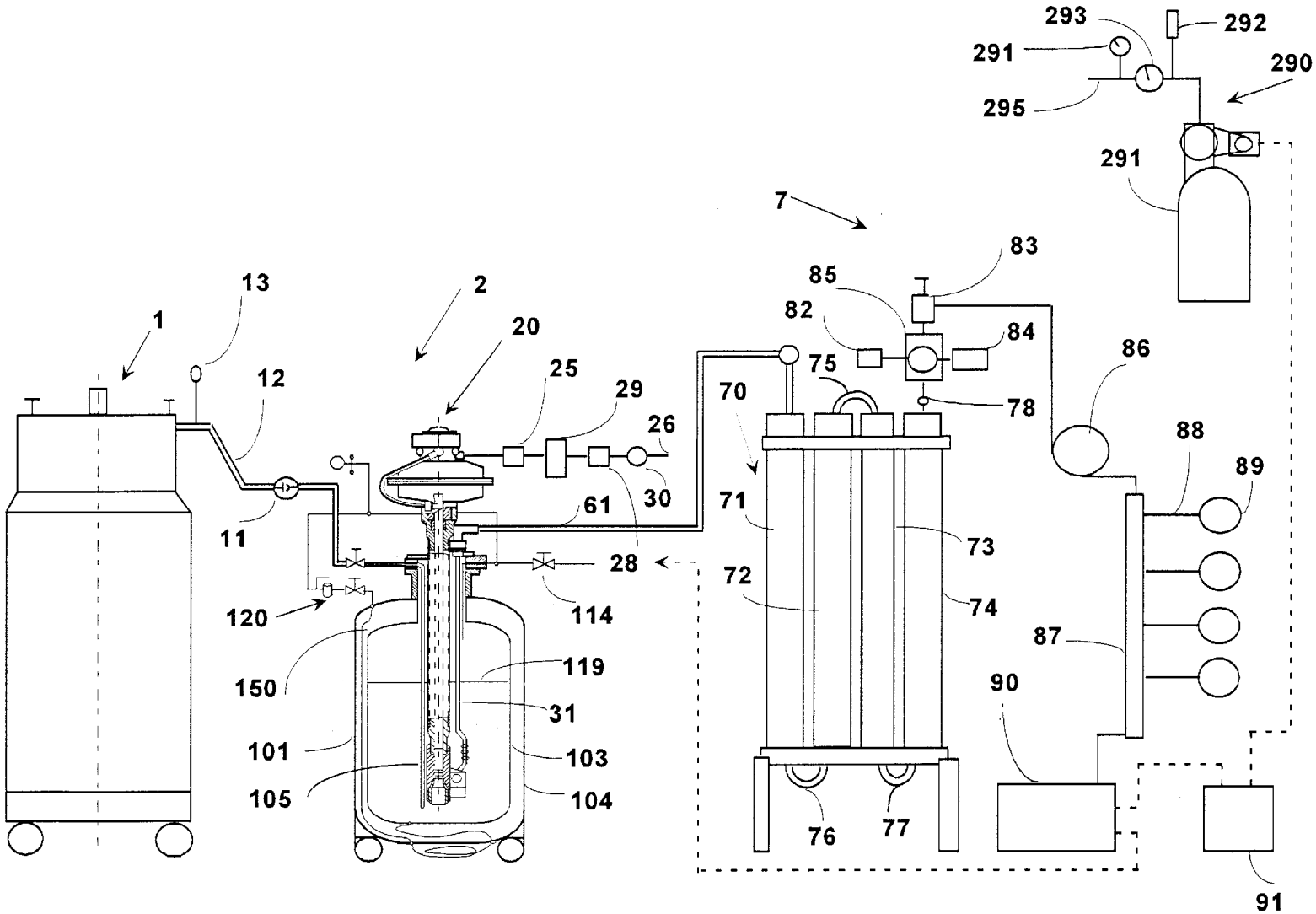
FIG. 2 is a schematic diagram of the portable cryogenic liquid holding cylinder, the pump system and a high pressure gas cylinder filling system (utilization system)

As shown schematically in FIG. 2, the total system includes portable cryogenic liquid holding cylinder 1, high pressure pump system 2 and high pressure utilization system 7, operating to pump cryogenic liquid from the portable liquid holding cylinder 1 to the high pressure cryogenic liquid utilization system 7.

As shown in FIGS. 1 and 2, cryogenic liquid such as liquid oxygen (LOX)is taken from holding cylinder 1 through fill hose 12 that draws liquid from the bottom of the holding cylinder and the liquid is forced by the pressure normally maintained in the cylinder to flow through check valve 11, through manually operated fill valve 108 and tube 107 that goes through the pump container flange 106 to cryogenic liquid input tube 105 inside the high pressure pump system 2 pump container 101. Pressure relief valve 13 in fill hose 12 limits the pressure of the cryogenic liquid in the holding cylinder 1. Container 101 is preferably constructed of inner 103 and outer 104 stainless steel shells with an evacuated space 150 in between surrounding the inner shell to insure low heat conduction to the cryogenic liquid 119 inside. The container has a channel 130 through the shells to inside the inner shell for cryogenic liquid input tube 105, the pump casing 22, high pressure fluid output conduit tube 31 and gas vent tube 111.

High pressure fluid output conduit tube 31 is from the pump 24 output 41 through check valve 42, for cryogenic liquid pumped at high pressure. It carries the cryogenic liquid at high pressure via high pressure pump output fitting 32 at the pump attaching flange 43 and via high pressure liquid line 61 to high pressure utilization system 7.

The channel 130 may be formed by a technique referred to as "Lost Motion Support", which is described in detail in my U.S. Pat. No. 4,674,289, issued Jun. 23, 1987, entitled: Cryogenic Liquid Container. That technique uses a thin wall inner tube that conducts very little heat and a thick wall structural tube that encloses the thin wall tube and provides structural support between the two shells and also provides an evacuated annular space around the thin wall tube. The thick wall structural tube connects rigidly to the outer shell and connects securely, but movably, to the inner shell, via spacers made of low thermal conductivity material, so that the inner shell can move laterally slightly within the outer shell, but not so much as to break the vacuum seal of the thin wall tube with the shells. By this technique, the inner shell is adequately supported from the outer shell by the structural tube, and yet the support structure does not provide a ready path for heat flow between the shells.

The pump container 101 gas vent tube 111 extends from the top of inner shell 103 up through neck 102 through the container flange 106 to line 113 that connects to manually operated vent valve 114, pressure gauge 115 (400 psig.), safety burst disk 116 (235 psig.) and relief valve 117.

A pressure building system 120 for pump container 101, (shown in FIG. 1), consists of pressure fitting 121 at the bottom of inner shell 103 that connects to another fitting 122 through outer shell 104 to pressure building vaporizing coil 123 and from that coil to another fitting 124 back through the outer shell to a length of rigid tubing 125 extending from fitting 124 upwards in the container in the vacuum space 150 between the shells to fitting 126 at the top of the outer shell. From fitting 126 the pressure building system goes to pressure building valve 127 and pressure building regulator 128 that connects to gas line 113 at the top of gas vent tube 111. The purpose of the pressure building system is to draw liquid 119 from the bottom of the container inner shell 103 as necessary to build the gas pressure in the container and valve 127 and pressure regulator 128 are adjusted to accomplish this. This "Pressure Building System" is also described in detail in my above described U.S. Pat. No. 4,674,289. For the present application, pressure in the pump container 101 should be maintained at 100 psig.

Portable cryogenic liquid cylinder 1 may also be constructed like the Cryogenic Liquid Container in my above described U.S. Pat. No. 4,674,289. It may have the "Lost Motion Support" feature and it preferably has a "Pressure Building System".

Figure 3:
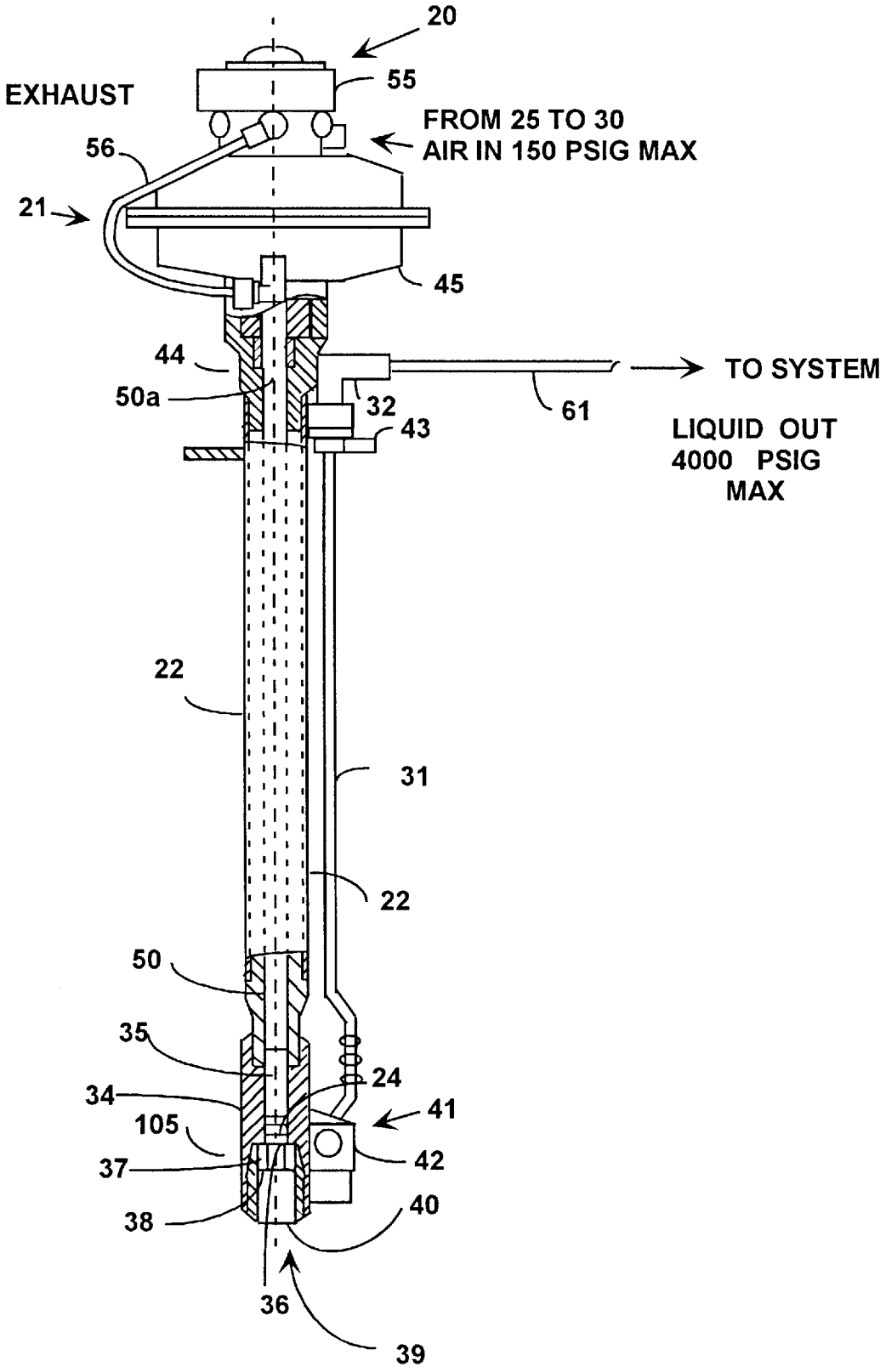
FIG. 3 is an enlarged partially cross section view showing some details of the pneumatically driven high pressure cryogenic liquid piston pump that is suitable for the pump system shown in FIGS. 1 and 2.

As shown in FIGS. 1 and 3, the pump 24 includes the pump cylinder body 34, piston 35, piston face 36, and piston chamber 37 defined by the piston face and the inside 38 of the cylinder. The pump input 39 is through input check valve 40 and the pump output 41 is through output check valve 42 to high pressure fluid output conduit tube 31.

The pump casing 22, as shown in FIGS. 1 and 3, carries the pump 24 at sufficient length from the pump mounting flange 43 that when the pump is mounted to pump container 101, the pump input 39 reaches substantially to the bottom of liquid 119 in the container inner shell 103. Pump casing 22 also extends upward through pump flange 43 to the pump actuator drive 21 and attaches thereto at pump piston drive bushing and seal assembly 44.

The bushing and seal assembly 44 attaches to pneumatic drive head assembly 45 that contains a high advantage pneumatic drive connected to the upper end 50*a* of the elongated pump piston drive shaft 50. Bushing and seal assembly 44 contains suitable seals against the upper end 50a of pump piston drive shaft 50 to prevent any flow of gas between the pneumatic drive head assembly 45 and the pump 24. For example, as shown in FIG. 2, pneumatic drive gas (air at about 150 psig.) is fed into the pneumatic drive head assembly head operating valve 55 from air inlet 26, via ball valve 30 solenoid valve 28, filter 29, regulator 25 and safety valve 27 to pneumatic drive head assembly operating valve 55, which feeds the pneumatic drive gas to the pneumatic drive contained therein, driving it downward and driving the piston 35 into chamber 37, which forces the cryogenic liquid from 119 that has been drawn into the chamber through output check valve 42, through high pressure fluid output conduit tube 31 to high pressure cryogenic liquid output line 61, via fitting 32. This pump action is a power stroke of the piston driven by a power stroke of the pneumatic drive.

After the power stroke, the pneumatic drive gas is exhausted through pneumatic head operating valve 55 and the pressure in container 101 maintained by pressure building system 120 on top of the contained cryogenic liquid 119, plus the liquid head in the container, acting against pump piston face 36 forces the piston upward. This upward movement of the piston is resisted by the weight of the pump piston 35 and drive shaft 50, the weight of pneumatic drive piston in head assembly 45 and by friction. There is no pneumatic resistance from head assembly 45, as pneumatic pressure differential across the pneumatic drive is neutralized by connecting air tube 56. This pump action is the intake stroke and does not draw cryogenic liquid into the pump chamber, but rather the cryogenic liquid at the bottom of the container is at sufficient pressure to flow through intake check valve 40 and raise the piston overcoming only intrinsic weight and friction to fill the chamber. By this action, with pressure maintained in the pump container by pressure building system 120 alone assures that there will not be cavitation or boiling of the cryogenic liquid at the pump input.

The pneumatic drive for the pump provided by pneumatic drive head assembly 45 as described herein, drives the pump only on the power stroke; it does not drive on the intake stroke. It is clearly a linear drive. Other kinds of linear drives could be used instead of the pneumatic drive. For example, an electric drive could be used. For that purpose an electric motor could be used driving a cam that engages the pump piston shaft at the driven end 50*a* thereof. The cam would be such that it would drive the piston for the power stroke and allow the piston to be returned on the intake stroke.

As shown in FIG. 2, the high pressure liquid line 61 from the pump system feeds the utilization system 7. For this example, system 7 is a high pressure gas cylinder filling system for filling conventional high pressure gas cylinders with the evaporated cryogenic liquid. In this case, it is LOX and so the gas cylinders are filled with oxygen at up to 3,500 psig. For that purpose, the high pressure LOX in line 61 is fed to vaporizer bank 70 which includes several lengths of finned tubes 71 to 74 connected in series by connections 75, 76 and 77 from finned tube to finned tube.

These finned tubes are highly thermally conductive and are heated by ambient air and completely vaporize the LOX fed thereto. At the last finned tube 74, high pressure oxygen gas flows from the tube in gas line 78 through pressure gauge (4,000 psig.) 85, past safety valve (3,500 psig.) 82 and pressure switch (3,100 psig.) 84, to shut-off valve and burst disk 83. From valve 83 the gas flows through pigtail line 86 to gas cylinder fill manifold 87 and fills conventional high pressure gas cylinders 89 with the oxygen, each through one of pigtail lines 88 feeding the cylinder from the manifold.

A vacuum pump 90 also connects to the cylinder manifold and serves to evacuate the gas filling system back to valve 83 of system 7. Evacuation by vacuum pump 90 can also be extended through the vaporizer bank 70 and high pressure cryogenic liquid line 61 all the way through pump output line 31, pump output check valve 42, pump chamber 37, pump input check valve 40 to the inside of inner shell 103 of pump container 101. Clearly, if purging gas is introduced into pump container fill hose 12 and valve 108 is open, the entire pump, pump container and utilization system is purged through vacuum pump 90.

Pneumatic air pressure for the air driven pump 20 is supplied by system 290 that includes an electric motor driven air compressor and 80 gallon tank 291 with air pressure switch (120–140 psig) 292, air regulator (115 psi.) 293, air pressure gauge 294 and air supply line (maximum 50 ft.) 295., which supplies air to air inlet 26 of air driven pump 20.

An electric timer 91 provides electric power, represented by broken lines, to: the electric motor drive in air compressor and 80 gallon tank 291; vacuum pump 90; and air inlet solenoid valve 28 that feeds the compressed air for the pneumatic drive of pump 20.

Operation of the entire system shown in FIG. 2 to pump cryogenic liquid from portable holding cylinder 1, by pump system 2 to system 7 filling high pressure gas cylinders 89, may be done in two steps. First, cryogenic liquid is fed from holding cylinder 1 via fill hose 12 through check valve 11 and fill value 108 to input tube 105 inside pump container 101 until the container is full. Then, the fill line 12 is closed and the pump system 2 and gas filling system 7 are turned on, filling high pressure gas cylinders 89, until the cryogenic liquid level 119 in the pump container falls below the pump input at which point the pump output pressure will drop and the pump will be shut off by an electric signal from electric control 91 which closes solenoid valve 28 shutting off pneumatic air feed to the pump drive 21. Then the steps are repeated.

Figure 4:
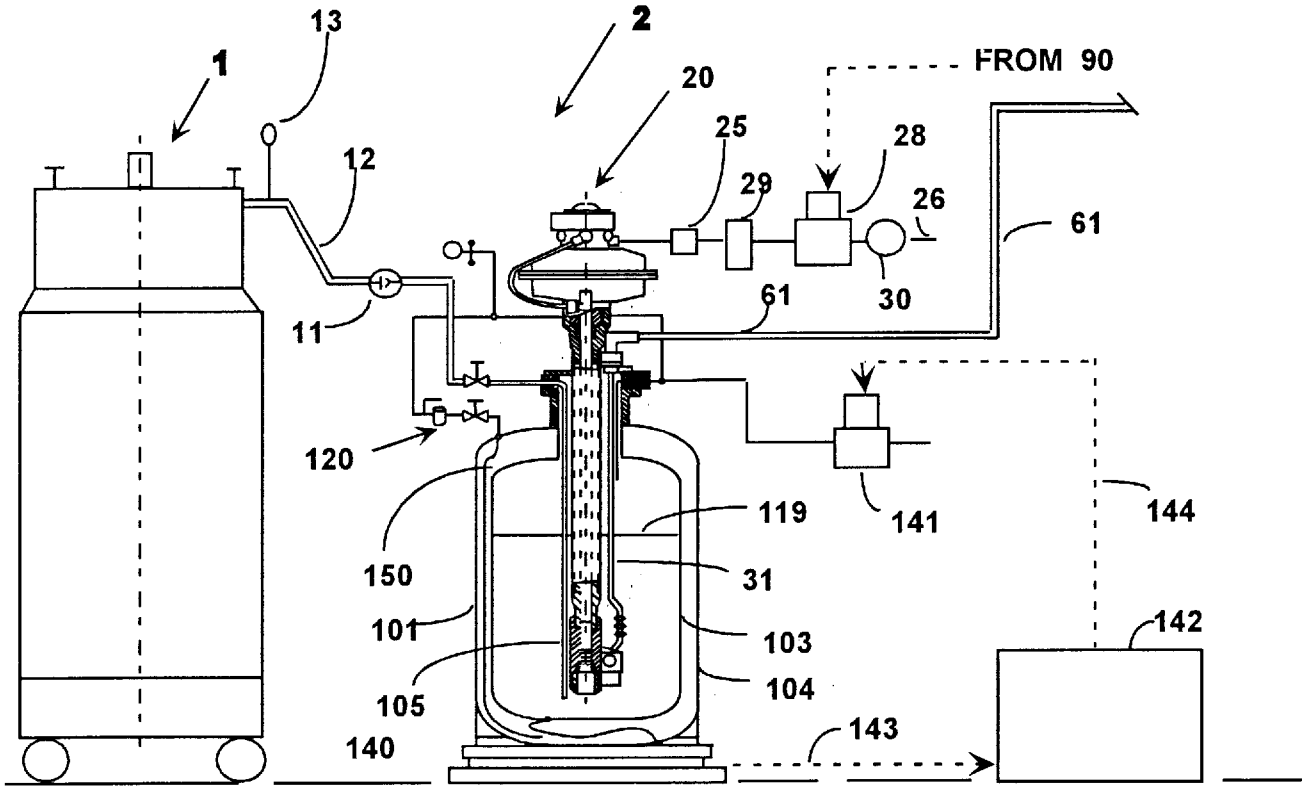
FIG. 4 shows the pump part of FIG. 2 modified for continuous operation.

FIG. 4 shows part of FIG. 2 modified for continuous flow operation. The modifications include: the substitution of solenoid valve 141 in vent line 113 for manually operated vent valve 114, which vents the pressure of gas inside pump container 101, via gas vent line 111; electric weight scale 140 on which the pump container 101 rests; electric pump container fill control 142 and electric lines 143 from the scale to the control and 144 from the control to solenoid valve 141.

Operation of the continuous flow system in FIG. 4 is done with the manually operated fill valve open. Beginning when the level of cryogenic liquid 119 in pump container 101 is between "low" and "high" levels indicated in FIG. 4, the gas pressure in the pump container on liquid 119 therein exceeds the pressure in holding cylinder 1 and so there is no flow in of liquid from the holding cylinder in fill line 12 through check valve 11 into the pump container via fill tube 105.

This pressure in the pump container 1 is maintained by pressure building system 120 described above. Under these conditions, the electric signal from scale 140 in line 143 represents a level between "low" and "high" and this signal is fed to electric control 142, which in turn produces a solenoid control signal in line 144 that maintains solenoid valve 141 closed.

Thereafter, when pump system 2 is turned on by an electric signal from electric control 91 to air solenoid valve 28, cryogenic liquid is pumped from container 101 through line 61 to the utilization system 7. When the level of liquid 119 falls to the "low" level, the electric signal from scale 140 in line 143 represents the "low" level and that signal is fed to electric control 142, which in turn produces a solenoid control signal in line 144 that maintains gas vent solenoid valve 141 open, venting the gas pressure in the pump container and allowing liquid flow in from holding cylinder 1 to pump container 101, via fill line 12, through check valve 11.

When this flow in raises the level to the "high" level, the electric signal from scale 140 in line 143 represents the level "high" and the electric control 142 produces a solenoid control signal in line 144 that closes solenoid valve 141 and pressure building system 120 again takes over and quickly increases gas pressure in the container to stop liquid flow in from the holding cylinder.

Thus, the level of cryogenic liquid 119 in the pump container is maintained between the between the "low" and "high" levels shown in FIG. 4, automatically, while the liquid is pumped at high pressure to utilization system 7 and during this pumping process that level is well above the NPSH requirements of the pump.

CONCLUSION

The pump system for cryogenic liquid described herein, its structures, flow and controls and uses with a stored cryogenic liquid bulk tank to fill high pressure gas cylinders incorporates in the several embodiments described all features of the present invention and represents the best known use of those features. It should be clearly understood that these features may be used in other equipments by those skilled in the art with some variations without departing from the spirit and scope of the invention set forth in the appended claims.

I claim:

1. A high pressure pumping system for pumping cryogenic liquid from a low pressure cryogenic liquid holding cylinder to a high pressure utilization system comprising, (a) a high pressure piston pump having an input and an output (b) said pump input being in a unidirectional flow path into said pump, (c) said pump output being in a unidirectional flow path out of said pump, (d) a low pressure cryogenic liquid pump container for holding cryogenic liquid from said low pressure cryogenic liquid holding cylinder, (e) means for feeding cryogenic liquid from said holding cylinder to said pump container, (f) said pump input and output being immersed in said cryogenic liquid in said pump container and (g) means for driving said pump piston, (h) whereby, said cryogenic liquid is pumped from said holding cylinder to said high pressure utilization system.

2. A high pressure pumping system as in claim 1 wherein, (a) means are provided to fill said low pressure pump container with cryogenic fluid from said low pressure cryogenic liquid holding cylinder.

3. A high pressure pumping system as in claim 1 wherein, (a) means are provided to maintain the pressure in said low pressure pump container.

4. A high pressure pumping system as in claim 1 wherein, (a) means are provided to maintain the pressure in said low pressure pump container at the level required for NPSH.

5. A high pressure pumping system as in claim 1 wherein, (a) means are provided to fill said low pressure pump container from said low pressure cryogenic liquid holding cylinder and (b) means are provided to maintain the pressure in said low pressure pump container.

6. A high pressure pumping system as in claim 5 wherein, (a) said means provided to fill said low pressure pump container from said low pressure cryogenic liquid holding cylinder includes:

(b) mean for detecting a decrease in the level of said cryogenic liquid in said container and producing a signal representative thereof, (c) a controlled valve for controlling the flow of said cryogenic liquid from said holding cylinder to said pump container and (d) means responsive to said signal for controlling said valve, (e) whereby said controlled valve opens when the level of said cryogenic liquid in said container falls below a predetermined level.

7. A high pressure pumping system as in claim 1 wherein, (a) means are provided to maintain the pressure in said low pressure pump container lower than the pressure in said low pressure cryogenic liquid holding cylinder.

8. A high pressure pumping system as in claim 1 wherein, (a) means are provided to maintain the pressure in said low pressure pump container sufficiently high that cavitation does not occur in said cryogenic liquid in said container at said pump input.

9. A high pressure pumping system as in claim 1 wherein, (a) means are provided to maintain the pressure in said low pressure pump container sufficiently high that boiling does not occur in said cryogenic liquid in said container at said pump input.

10. A high pressure pumping system as in claim 1 wherein, (a) said pump has a piston, a piston cylinder, a piston chamber and said pump has a power stroke and an intake stroke and (b) means are provided to maintain the pressure in said low pressure pump container sufficiently high that cryogenic liquid flows into said piston chamber forcing said pump intake stroke.

11. A high pressure pumping system as in claim 10 wherein, (a) the only driving force on said piston during said intake stroke is from the pressure of said cryogenic liquid in said container at said pump intake.

12. A high pressure pumping system for pumping cryogenic liquid from a low pressure cryogenic liquid holding cylinder to a high pressure utilization system comprising, (a) a high pressure piston pump having:

(b) a piston cylinder, (c) a pump piston having a piston face in said piston cylinder, (d) a piston chamber defined by said piston face and said piston cylinder, (e) means for driving said piston from a first position in said cylinder to a second position in said cylinder, (f) a unidirectional cryogenic liquid flow path from outside said cylinder into said piston chamber, (g) a high pressure cryogenic liquid output line to said high pressure utilization system, (h) a unidirectional cryogenic liquid flow path from said chamber to said output line and (i) a low pressure cryogenic liquid pump container for said pump and (j) means for feeding cryogenic liquid from said low pressure cryogenic liquid holding cylinder to said low pressure pump container, (k) said piston cylinder being immersed in said cryogenic liquid in said low pressure pump container and (l) means for driving said pump piston, (m) whereby said cryogenic liquid is pumped from said low pressure cryogenic liquid holding cylinder to said high pressure utilization system.

13. A high pressure pumping system as in claim 12 wherein, (a) means are provided to fill said low pressure pump container from said low pressure cryogenic liquid holding cylinder and (b) means are provided to maintain the pressure in said low pressure pump container.

14. A high pressure pumping system as in claim 12 wherein, (a) means are provided to maintain the pressure in said low pressure pump container lower than the pressure in said low pressure holding cylinder.

15. A high pressure pumping system as in claim 12 wherein, (a) means are provided to maintain the pressure in said low pressure pump container sufficiently high that cavitation does not occur in said cryogenic liquid in said container at said pump input.

16. In a system for storing cryogenic liquid in a low pressure cryogenic liquid bulk holding tank from which said cryogenic liquid is drawn off from time to time in small quantities and pumped to a high pressure gas cylinder filling system, a high pressure pumping system for pumping said cryogenic liquid from said low pressure holding tank to said high pressure gas cylinder filling system, comprising, (a) a high pressure piston pump having an input and an output (b) said pump input being a unidirectional flow path into said pump, (c) said pump output being a unidirectional flow path out of said pump, (b) a low pressure cryogenic liquid pump container for holding cryogenic liquid from said bulk holding tank, (c) means for feeding cryogenic liquid from said bulk holding tank to said pump container, (d) said pump input and output being immersed in said cryogenic liquid in said pump container and (e) means for driving said pump piston, (f) whereby said cryogenic liquid is pumped from said cryogenic liquid bulk holding tank to said high pressure gas cylinder filling system.

17. A high pressure pumping system as in claim 16 wherein, (a) means are provided to fill said low pressure pump container from said low pressure cryogenic liquid bulk holding tank.

18. A system as in claim 16 wherein, (a) means are provided to maintain the pressure in said low pressure pump container.

19. A system as in claim 16 wherein, (a) means are provided to maintain the pressure in said low pressure bulk holding tank and (a) means are provided to maintain the pressure in said low pressure pump container lower than the pressure in said low pressure bulk holding tank.

20. A method of pumping cryogenic liquid from a low pressure cryogenic liquid holding cylinder to a high pressure utilization system including the steps of:

(a) immersing a high pressure piston pump that has a low pressure cryogenic liquid input and a high pressure cryogenic liquid output in a pump container, (b) filling said pump container with said cryogenic liquid from said holding cylinder so that said pump input is below the level of said liquid in said pump container sufficiently that cavitation does not occur in said liquid at said pump input, (c) driving said pump to pump said cryogenic liquid from said pump container to said high pressure utilization system and (d) refilling said pump container as necessary so that said pump input is below the level of said liquid in said pump container sufficiently that cavitation does not occur in said liquid at said pump input.

* * * * *